US005337821A

United States Patent [19]

Peterson

[11] Patent Number: 5,337,821

[45] Date of Patent: Aug. 16, 1994

[54] METHOD AND APPARATUS FOR THE DETERMINATION OF FORMATION FLUID FLOW RATES AND RESERVOIR DELIVERABILITY

[75] Inventor: Gregg L. Peterson, Calgary, Canada

[73] Assignee: Aqrit Industries Ltd., Calgary, Canada

[21] Appl. No.: 14,132

[22] Filed: Feb. 5, 1993

[30] Foreign Application Priority Data

Jan. 17, 1991 [CA] Canada ..... 2034444

[51] Int. Cl.[5] ..... E21B 43/00

[52] U.S. Cl. ..... 166/250; 175/48

[58] Field of Search ..... 166/250, 252; 175/40, 175/48

[56] References Cited

U.S. PATENT DOCUMENTS

| | | | |
|---|---|---|---|
| 4,295,366 | 10/1981 | Gibson et al. | 175/48 X |
| 4,610,161 | 9/1986 | Gehrig et al. | 175/48 X |
| 4,716,973 | 1/1988 | Cobern | 166/250 X |
| 4,905,203 | 2/1990 | Sims et al. | 175/48 X |

*Primary Examiner*—Thuy M. Bui

[57] ABSTRACT

A method and apparatus for measuring fluid flow rates, reservoir deliverability and/or the absolute open flow (AOF) potential of a subterranean formation penetrated by a wellbore. The present invention can be described as a formation fluid flow rate test tool which is conveyed and operated on a wireline logging cable. The down hole test tool comprises an arrangement of inflatable packers to isolate an interval and a pump which extracts fluid from the formation through an inlet below the upper most packer. The method allows for sequentially increasing or decreasing the flow rates and measuring the corresponding pressure responses. From this data, the reservoir flow characteristics, properties and deliverability can be accurately calculated, which was not previously permitted with other known wireline conveyed sampling and testing tools. Additionally, the present invention allows for the reservoir parameters to be obtained under dynamic conditions, emulating a deliverability test. This method and apparatus presents an economical and time effective technique with which to enter into a decision regarding the disposition of a wellbore.

12 Claims, 5 Drawing Sheets

1
2
10
3a
4
7
8
8
8
9
11
6
3b
12
5

METHOD AND APPARATUS FOR THE DETERMINATION OF FORMATION FLUID FLOW RATES AND RESERVOIR DELIVERABILITY

BACKGROUND OF THE INVENTION

1. Field of the Invention

During the life of a well, periodic measurements and tests are performed to better understand the quality of a reservoir. Some tests are made at the surface and some are performed down hole by sophisticated tools that are lowered into the wellbore.

This invention involves a method for acquiring formation fluid flow rates and calculating the reservoir deliverability by means of a wireline conveyed tool. The field of this invention relates specifically to, designed down hole tools to measure formation fluid flow rates. In the operation of drilling oil and gas wells, it is desirable to evaluate the reservoir deliverability at a stage early enough to make the best economical decision regarding the disposition of the wellbore. This invention allows for the reservoir flow rates to be determined by an apparatus lowered on a wireline into an uncased or cased borehole. A set of inflatable packers are used to isolate an interval of a formation and a flow rate test is performed. The results obtained during the flow test period are transmitted to the surface whereby calculations and deductions can be made as to the validity of the measurements. This ability to record and interpret data as to the potential flow rate of a reservoir, essentially in real time, is of extreme importance to those engaged in well bore evaluations, completions and reserve determinations.

2. Description of the Prior Art

In the past, representative formation fluid flow rate measurements have been primarily restricted to operations involving the use of drill pipe type methods (Drill-stem Tests) or production testing. Attempts have been made to measure flow rates using wireline formation sampling and testing tools for many years. The Formation Tester, as it is well known, is a wireline tool used for measuring inferred formation properties and collecting fluid samples. A variety of tools are available to obtain uncontaminated formation fluid samples by means of isolating the wellbore, collecting a sample and measuring the fluid properties. Based on the fluid test results the sample is recovered in a chamber or rejected into the borehole. In the past, the measuring of formation properties by wireline tools has produced unreliable information on the reservoirs ability to produce fluids and estimate the fluid flow rates as a result of the limited tool capacity and capabilities. The financial benefit of performing fluid flow rate tests using a wireline tool, combined with increased data reliability and accuracy is of immense concern to the oil and gas industry.

The remaining discussion on prior art methods and apparatus will strictly be in regards to down hole wireline operations.

In the past, a pair of packers mounted on a wireline tool were lowered into a borehole to obtain formation fluid samples. Expanding the packers isolated an interval in the borehole from which fluids may be drawn into the tool for analysis. If the formation permitted fluid flow and the fluid was suitable for sampling, collection to sample chamber was performed. An example of such a tool is described in U.S. Pat. No. 4,535,843 entitled "Method and Apparatus for Obtaining Selected Samples of Formation Fluids". The tool described in the '843 patent was used to measure fluid properties and collect samples and was not used to determine reservoir fluid flow rates.

Many of the wireline formation testers utilize a probe assembly which extends through a sealing pad into the formation to isolate the tool sample point from the well bore. These tools are capable of obtaining pressure measurements and if desired a sample of the fluids in communication with the sample point. However, during the drilling process of a well, the drilling fluid will invade a permeable formation causing pressure and fluid distortions. Therefore, to make accurate measurements of the essential parameters, virgin reservoir conditions must be observed by the tool. A tool capable of removing the drilling effects must be used before meaningful data can be obtained. The probe type tester has been used to estimate formation permeability, but due to the shallow depth of investigation during fluid removal the tool has its limitations. Multiple probe modifications have been designed in an attempt to improve the situation (such as the tool described in U.S. Pat. No. 4,860,580 entitled Formation Testing Apparatus and Method). The tool in the '580 patent was intended to predict the nature of the formation connate fluid by the accurate determination of the pressure versus depth gradient between the two probe assemblies. By increasing the distance between the probes, deeper depth of investigation can be achieved. But, this technique is limited due to the small bore hole wall area exposed with the probe tools which affects the fluid extraction rate towards the sample point. This sink point also causes the magnitude of the pressure response between the two probes to decrease with increased probe spacing. Therefore, when one wants to measure high reservoir fluid flow rates it is desirable to use a device which is not a probe type testing tool.

Other formation sampling and testing devices have been implemented such as the apparatus found in U.S. Pat. No. 4,513,612 entitled Multiple Flow Rate Formation Testing Device and Method. The tool described in the '612 patent employs the use of a fluid sampling probe and is restricted to the same limitations as discussed.

Flow control by using a restriction device to allow sampling at a constant pressure or constant flow rate can be used to enhance multi probe permeability determinations and such a sampling tool is illustrated in U.S. Pat. No. 4,936,139 entitled Down Hole Method for Determination of Formation Properties. Since the sampling apparatus in the '139 patent had an objective of measuring formation permeability and extracting uncontaminated samples above bubble point pressures, reservoir deliverability and/or the absolute open flow (AOF) potential of the formation was of no concern.

The apparatus of the present invention is designed to allow a large area of the borehole to be exposed for fluid removal by the use of a set of inflatable packers spaced some distance apart which isolates an interval of the formation. This will reduce the affect of the point source used in probe tools and enhance the fluid flow rate determinations. The tool employs a pump which is used to draw large volumes of fluids to an inlet positioned between the packers and discharges the fluid above the top packer. Utilizing the pump to control flow rate and allowing the formation to produce larger volumes of fluids than known designs, permits the opportunity to determine the reservoir deliverability of the formations tested.

A preferred method for obtaining formation deliverability is by means of wireline testing tools because more complete accurate measurements can be made in a fraction of the time required by current drill pipe techniques. The existing limitations with the probe type testers and the bubble point pressure restriction devices warrant an improved method to determine the reservoir deliverability and/or the absolute open flow (AOF) potential of a reservoir. The present invention allows for formation fluid flow rates to be determined by eliminating some of the known wireline tool limitations.

SUMMARY OF THE INVENTION

The method of the invention is to measure a subterranean formation fluid flow rate by employing a down hole wireline tool. The tool incorporates a high volume pump and an arrangement of variably spaced inflatable packers. The inflatable packers isolate an interval in the bore hole, (unlike the probe type tools) and the pump system allows the formation to flow at rates not permitted with known designs.

The apparatus of the present invention allows for the formation fluid flow rate to be sequentially increased or decreased, and with the simultaneous recording of the corresponding pressures, the reservoir deliverability and/or the absolute open flow (AOF) potential of the formation can be predicted. Also, the pump extracts large volumes of fluid which permits the measurements to be obtained at essentially the uninvaded conditions (virgin) of the reservoir.

The purpose of this invention is to provide an improved method and apparatus for measuring the .deliverability of a formation. Additionally, the versatility of wireline conveyed tool enables many multiple flow rate tests to be performed on a single descent into a well bore. The wireline cable provides surface control of the tool functions which assures that the recorded data is of sufficient quality. This monitoring of the measurements as they are recorded improves the reliability and credibility of the test results. Combined with the economical benefits, the method and apparatus will provide the necessary information for those individuals deciding the disposition of a well bore.

DETAILED DESCRIPTION OF THE INVENTION

Figure 1:
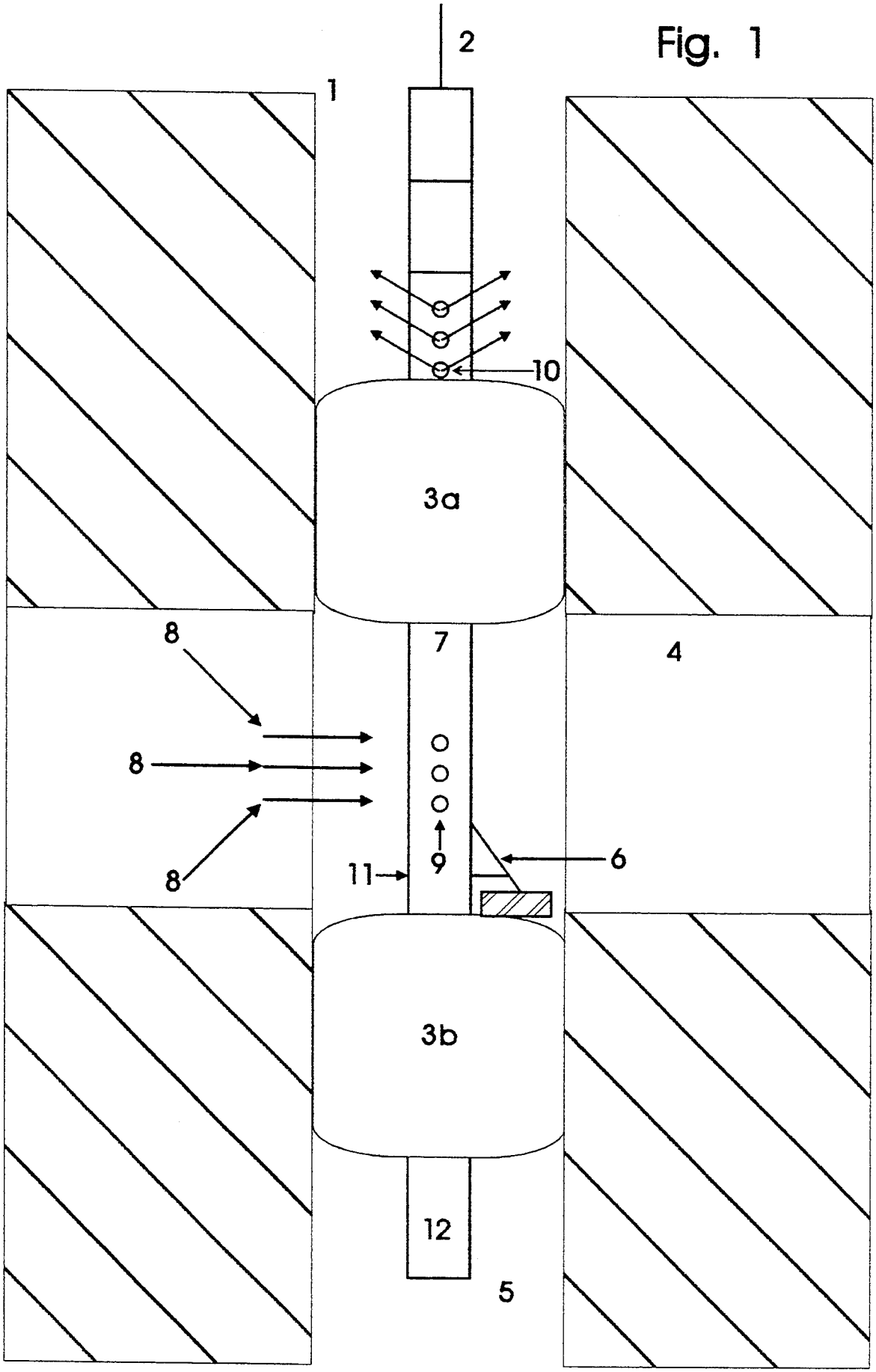
FIG. 1 is a side view of the downhole tool within a section, of the wellbore. The packers are inflated, sealing the desired section of wellbore. The formation fluids are drawn through the tool by the pump, and thus a fluid flow rate test is depicted.

In FIG. 1 the tool is shown in the testing position in a wellbore 1 that penetrates a subterranean earth formation. The tool is suspended in the wellbore by wireline logging cable 2, inflated rubber packers 3*a* and 3*b* isolate a zone of interest of the earth formation 4 from the wellbore fluids 5. Packer support arms 6 help prevent the rubber packers from failing due to large differential pressures. A downhole pump located in the pump section 7 is drawing formation fluids 8 through the inlet 9 and exiting 10 above the upper most packer 3*a*. The ability exists to vary the pump rate with which produces the necessary flow rates. Corresponding pressure, temperature and fluid density values are measured instantaneously and sent uphole via the logging cable 2 where they can be used to calculate the reservoir deliverability and/or absolute open flow potential (AOF) of the zone of interest. Once sufficient data has been obtained from a particular zone of interest, the pumping is stopped and the packers deflated, and the tool can now be moved to another zone of interest and the test procedure repeated.

The distance between the two packers can be set to any preselected value (at surface) based on the zone of interest size and/or the desired test outcome. This is accomplished by changing the length of tool 11 between the packers.

A sample chamber 12 can be placed in the lower section of the tool and filled at any desired time from any particular zone of interest.

Figure 2:
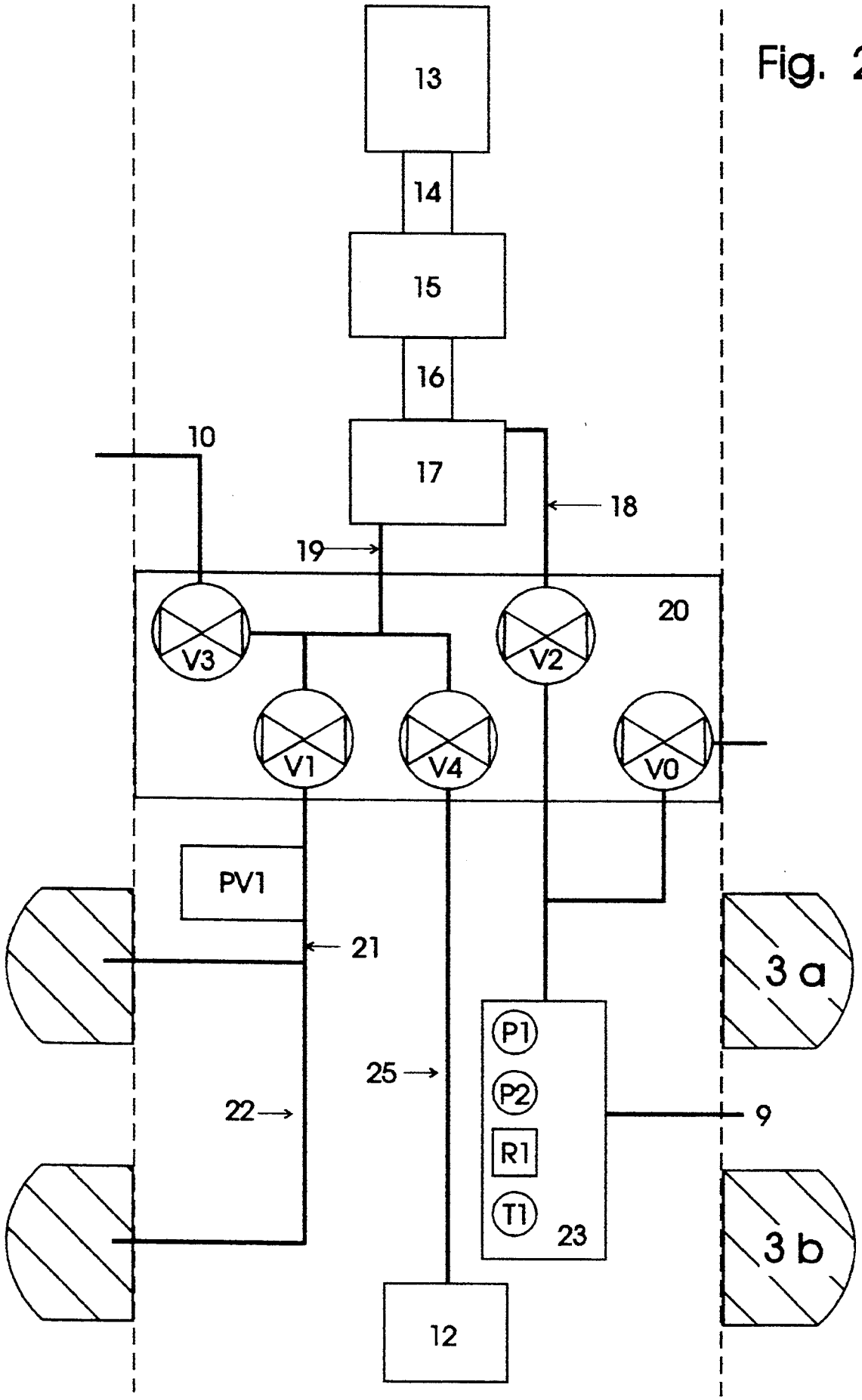
FIG. 2 is a schematic of the tool showing the relationship of the various components.

In FIG. 2 a schematic of the tool components is shown. When the tool is positioned over a particular zone of interest, the following would represent a typical sequence for performing a deliverability or AOF test:

(i) Equalizing valve V0 and flow line valve V2 are opened (all valves are closed prior to descending into the wellbore) allowing hydrostatic equalization across inflatable packer 3*a*.

Figure 3:
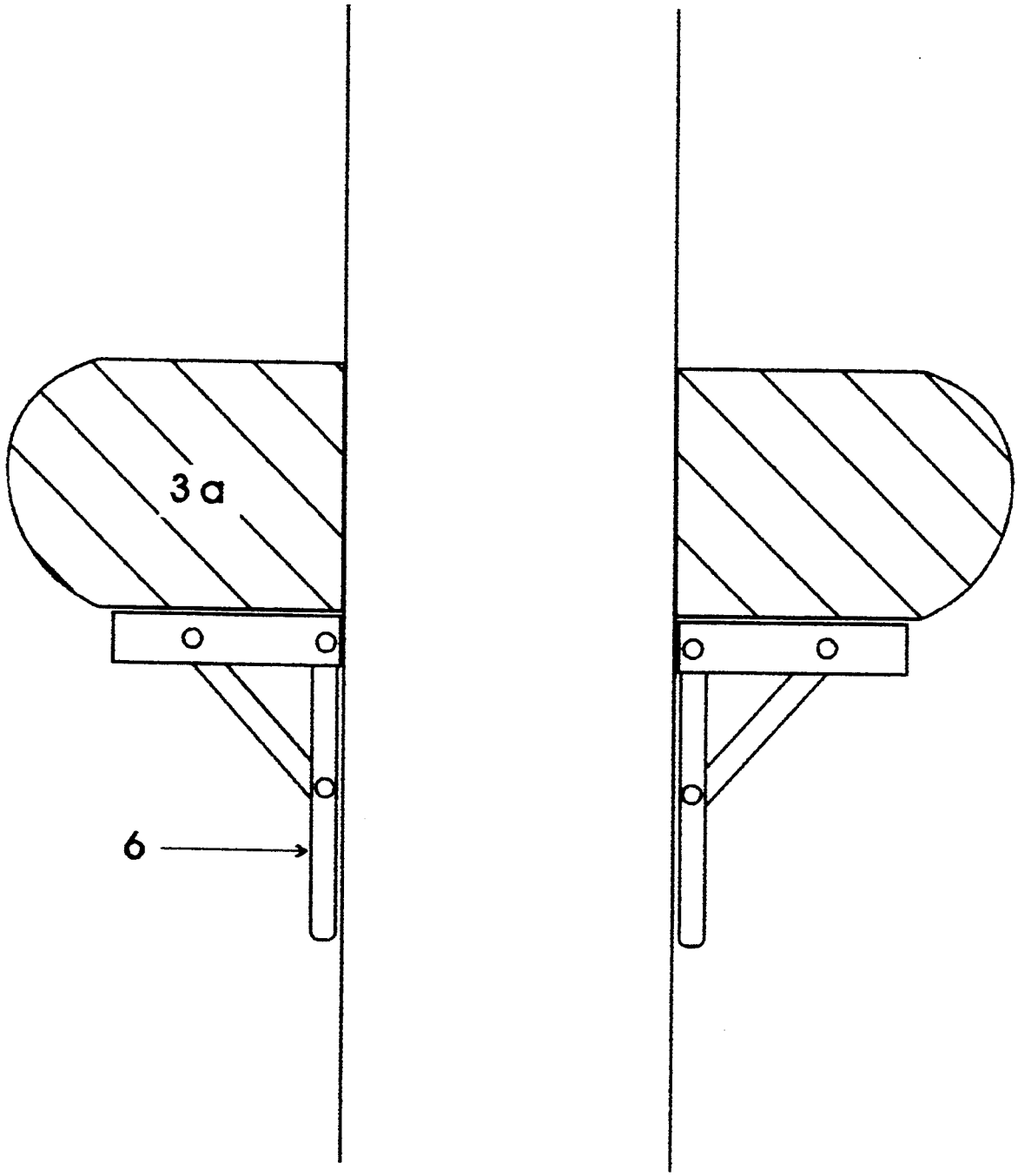
FIG. 3 is a sketch of the packer support arms.

(ii) Valve V1 is opened. The electric motor 13 is actuated and a low constant speed is selected. The output shaft 14 of the electric motor is attached to a gear reduction system 15 effectively reducing the speed of the output shaft 16. The output shaft 16 turns the pump 17 and, the speed of shaft 16 and the displacement of the pump in cubic ft/min determines the displacement rate or flow rate through line 18, the pump flow rate can be controlled by other means not limited to the scope of this document (e.g. hydraulically). Wellbore fluids are drawn through line 18 into the pump 17 and expelled through line 19 to the valve body 20. From the valve body the fluids are directed through line 21 which is connected to packers 3*a* & 3*b* via line 22. Line 22 may be of various lengths based on the variable packer spacing discussed earlier. As the pump continues to flow wellbore fluids, the inflatable packers 3*a* & 3*b* start to inflate. As they inflate, packer support arms 6 in FIG. 3 are engaged by the expanding bladder material of the packer and become fully engaged when the packers are fully inflated. This enables greater hydrostatic pressures to be withheld than by conventional inflatable packers. Complete packer inflation occurs at a predetermined pressure and this is ascertained by pop valve PV1 which will prevent over pressurizing the packers. The pump is then stopped and valve V1 is closed.

(iii) Equalizing valve V0 is closed and the zone of interest between the packers is effectively sealed from the rest of the wellbore fluids.

(iv) Flow rate testing can now begin. Valve V3 is opened, this will allow fluids to be expelled above packer 3*a* when the pump is actuated.

(v) The electric motor 13 is set to a low speed and the pump 17 draws fluid from the interval between the packers through port 9 and expels the fluid above packer 3*a* at port 10. The speed of electric motor is directly proportional to the pump displacement rate and hence flow rate. This accuracy of measuring flow rate is uncommon in previous testing techniques. The measurement of the zone of interest pressure response occurs in the measurement section 23. There are two pressure transducers P1 & P2 located here as well as a temperature sensor T1 and a resistance sensor R1. As fluid is dynamically drawn through the measurement section instantaneous pressure, temperature, pump rate, differential pressure and fluid resistivity are sent up to surface via the telemetry cartridge 24 and logging cable 2 for analysis. Fluid density can be determined from the differential pressure and distance between transducers P1 & P2. This along with fluid resistivity provides the important information to determine the physical fluid properties present during testing which is critical in determining reservoir parameters accurately.

Figure 4:
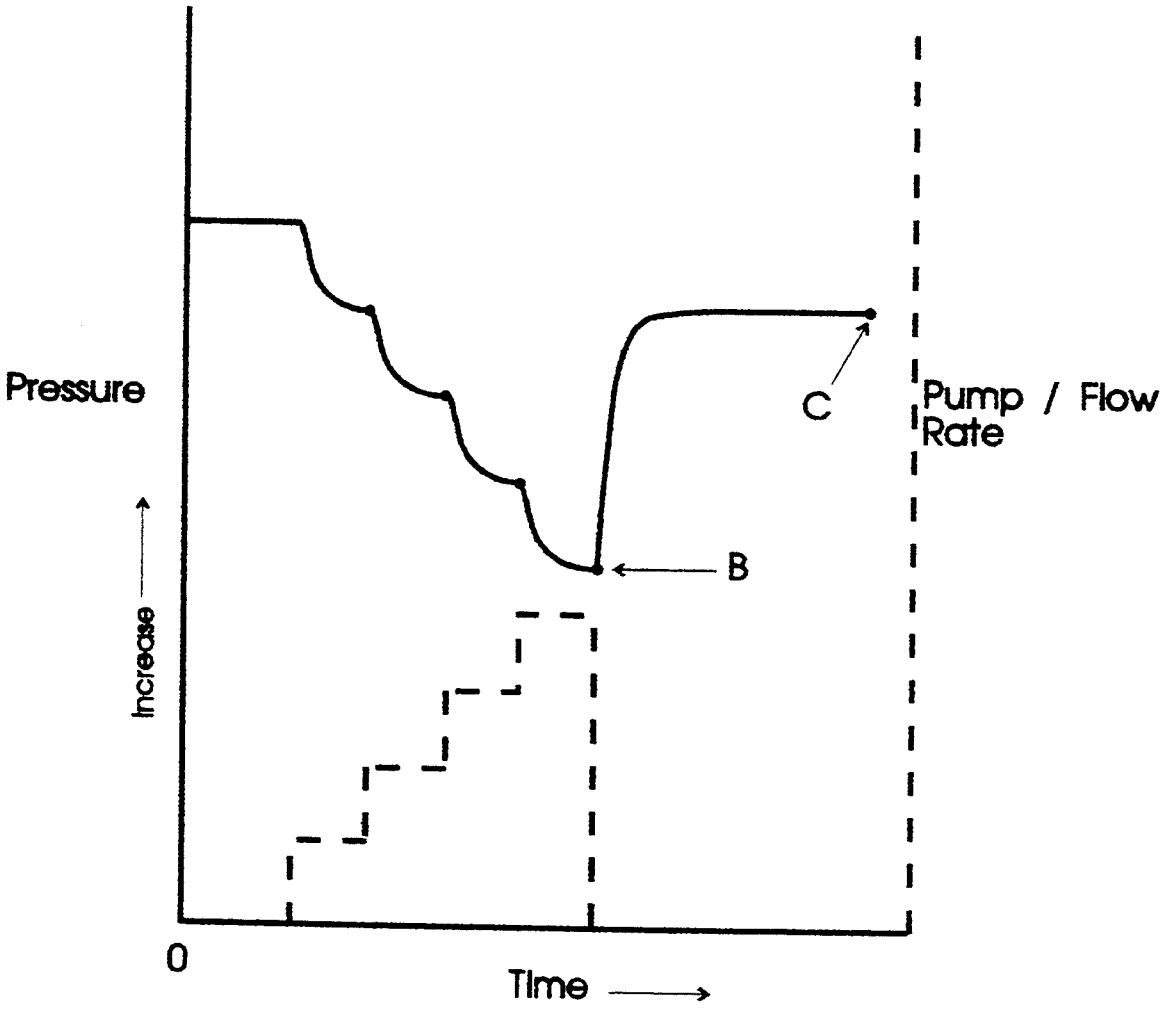
FIG. 4 is a graph of simulated recorded data.

(vi) Once the pressure response is determined to be satisfactory the flow rate can be changed to another level. The sequence of changing the pumping rate is repeated until enough information is gathered to determine the AOF of the zone of interest. After the final flow period, the pump is stopped and valve V3 is closed and the zone of interest is allowed to build up pressure back to the reservoir pressure. A simulated test plot is shown in FIG. 4. The instantaneous pressure/time and flow rates are graphed here. As the pump rate increases in this example, the corresponding pressure decreases. The buildup test is shown to start at point B and the final buildup pressure is recorded at point C. Other presentation formats are possible i.e. fluid density, temperature, fluid resistance etc. and are only limited to ones desire.

(vii) Valve V4 can be opened after the buildup test and a representative sample of connate fluid from the zone of interest will flow through line 25 to the sample chamber 12. This may occur by one of two ways:

(a) Either the formation has enough deliverability to fill the sample chamber itself, or (b) The pump 17 may be turned on which will draw formation fluids through line 18 into the pump and to the sample chamber via lines 9 & 25. This represents an improvement in sampling techniques because the system does not rely on the formation to fill the sample chamber. "Poor" performing reservoirs' can still be drawn or "vacuumed" into the sample chamber.

Figure 5:
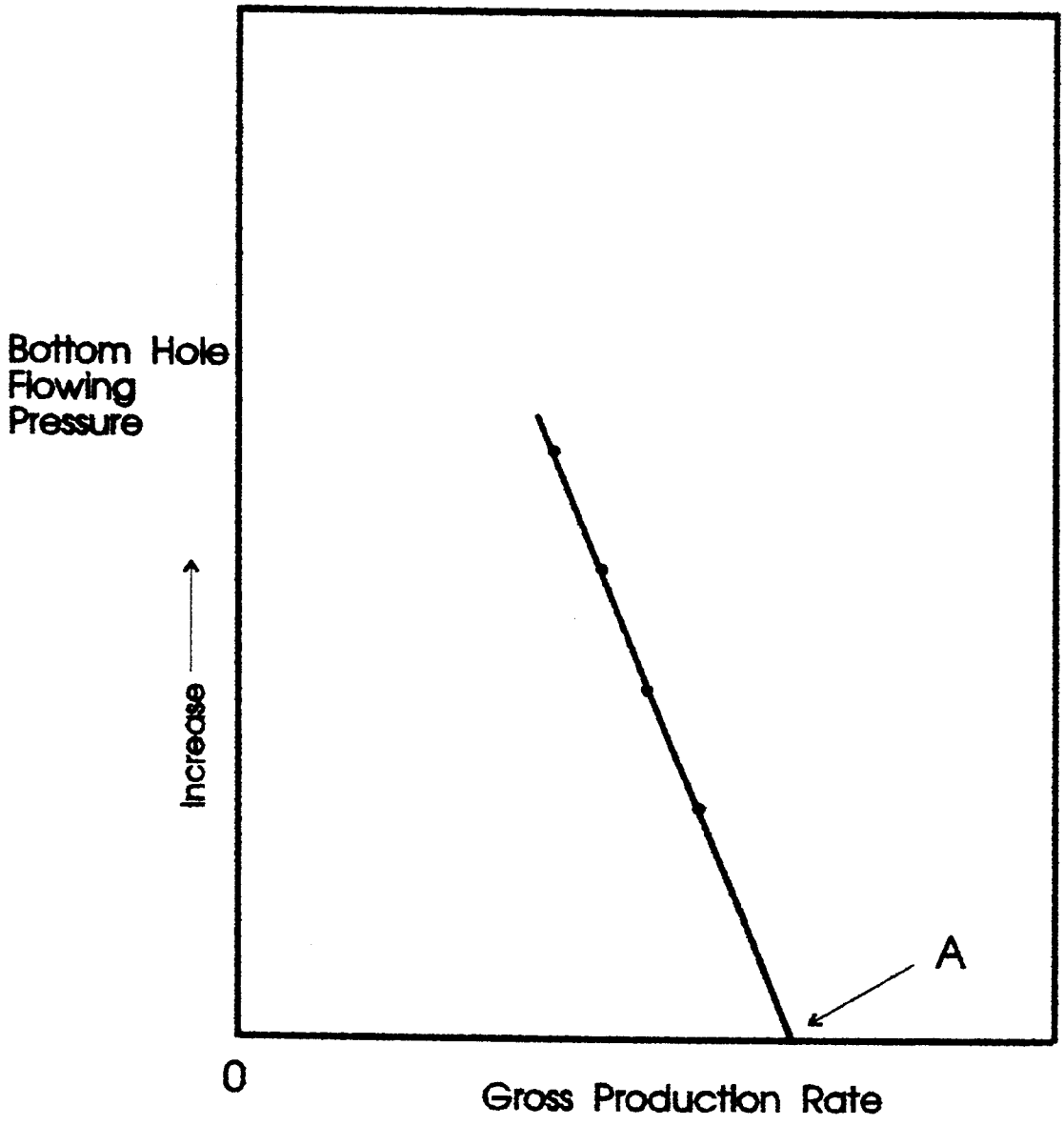
FIG. 5 is a graph of bottom hole flowing pressure vs. gross production rate used to determine reservoir performance.

In FIG. 5 the data that was acquired during the test period is graphed in another way. This graph is a graph of bottom hole flowing pressure versus the gross production rate. By simply extrapolating the graph to bottom hole flowing pressure=zero, the open flow potential can be found at A. The graphical representation of results is not limited and can be presented in a variety of forms and analyzed by those versed in the art of well testing.

It is worthy to note that by switching the intake line 18 with the exhaust line 19 by means of an additional valve (not shown) the pump can be used to pump fluids into a formation and information such as injection rates and rock stress properties can be inferred.

As may be seen, therefore, the present invention has many advantages. Firstly, it provides versatility with the size of the zone of interest to be tested in that the packer spacing may be selected as to the desired test outcome. Secondly, it provides a quick and economical way of deciding the disposition of the wellbore. Thirdly, the packer support arms provide additional support for the packers, extending the hydrostatic limitations of current packer designs. Fourthly, by varying and accurately measuring downhole flow rates and pressure responses, a more accurate indication of formation performance can be achieved now than with previous testing techniques. Fifthly, the ability to measure the different liquid phases during testing adds to the accuracy of the testing technique. Sixthly, the downhole pump facilitates sample taking from poor performing reservoirs. Seventhly, the method of testing is not limited to the borehole environment (e.g. cased or uncased). Seventhly, the direction of fluid flow through the pump can be changed to perform additional injection tests.

Various changes and or modifications such as will present themselves to those familiar with the art may be made in the method and apparatus described herein without departing from the spirit of this invention whose scope is to fall within these claims.

What is claimed is:

1. A method for obtaining the formation skin damage corrected reservoir deliverability and/or absolute open flow potential of a subterranean formation, comprising the steps of:

(a) lowering a tool conveyed by a wireline cable into a well bore to a preselected depth;

(b) inflating a pair of rubber packers to isolate an interval of said formation from the well bore fluids;

(c) pumping formation fluids at a measurably controlled pumping rate from said isolated interval and discharge to said well bore;

(d) measuring the formation fluid pressure by pressure measurement means;

(e) increasing or decreasing the said pumping rate and measuring the corresponding said formation fluid pressure;

(f) transmitting said formation fluid pressure and pumping rate to the surface via the said wireline cable;

(g) deflating said rubber packers allowing said tool to be positioned at another depth in the said well bore;

(h) repeating steps (b) through (g) until all the desired formations in the said well bore have been examined; and (i) retrieving said wireline and tool to the surface.

2. A method according to claim 1 further comprising the steps of:

(a) determining the rate dependent formation skin damage for each of the said pumping rates;

(b) correcting the said formation fluid pressure for the pressure drop caused by the amount of formation skin damage; and (c) calculating the relationship between the said corrected pressure and pumping rate, which determines the corrected reservoir deliverability or absolute open flow potential.

3. A method for obtaining the injection rate of a subterranean formation, comprising the steps of:

(a) lowering a tool conveyed by a wireline cable into a well bore to a preselected depth;
(b) inflating a pair of rubber packers to isolate an interval of said formation from the well bore fluids;
(c) pumping said well bore fluids at a measurably controlled pumping rate and injecting into said isolated interval;
(d) measuring the formation fluid pressure by pressure measurement means;
(e) increasing the said pumping rate and measure the corresponding said formation fluid pressure;
(f) transmitting said formation fluid pressure and pumping rate to the surface via the said wireline cable;
(g) determining the said formation injection rate from the said transmitted information;
(h) deflating said rubber packers allowing said tool to be positioned at another depth in the said well bore;
(i) repeating steps (b) through (h) until all the desired formations in the said well bore have been examined; and
(j) retrieving said wireline and tool to the surface.

4. A method according to claims 3 further comprising increasing the said pumping injection rate to determine the formation fluid pressure at which the formation rock will stress crack.

5. A method for obtaining formation fluid samples from low productivity subterranean formations, comprising the steps of:
(a) lowering a tool conveyed by a wireline cable into a well bore to a preselected depth;
(b) inflating a pair of rubber packers to isolate an interval of said formation from the well bore fluids;
(c) pumping formation fluids at a measurably controlled pumping rate from said isolated interval and discharge to a sample chamber;
(d) measuring physical properties of formation fluids by fluid analysis means;
(e) deflating said rubber packers allowing said tool to be positioned at another depth in the said well bore;
(f) repeating steps (b) through (e) until all the desired formations in the said well bore have been examined; and
(g) retrieving said wireline and tool to the surface.

6. A method according to claim 5 further comprising pumping formation fluids to said sample chamber at vacuum pressure.

7. A method for injection of a selected fluid into a subterranean formation, comprising the steps of:
(a) lowering a tool conveyed by a wireline cable into a well bore to a preselected depth;
(b) inflating a pair of rubber packers to isolate an interval of said formation from the well bore fluids;
(c) pumping said selected fluid from a sample chamber at a measurably controlled pumping rate to said isolated interval;
(d) measuring the formation fluid pressure by pressure measurement means;
(e) increasing the said pumping rate and measure the corresponding said formation fluid pressure;
(f) transmitting said fluid pressure and pumping rate to the surface via the said wireline cable;
(g) determining the said formation injection rate from the said transmitted information;
(h) deflating said rubber packers allowing said tool to be positioned at another depth in the said well bore;
(i) repeating steps (b) through (h) until all the desired formations in the said well bore have been examined; and
(j) retrieving said wireline and tool to the surface.

8. A method according to claim 7 further comprising the steps of:
(a) pumping formation fluids at a measurably controlled pumping rate from said isolated interval and discharge to said well bore;
(b) measuring the formation fluid pressure by pressure measurement mean;
(c) increasing or decreasing the said pumping rate and measure the corresponding said formation fluid pressure;
(d) transmitting said formation fluid pressure and pumping rate to the surface via the said wireline cable; and
(e) determining the change in formation skin damage of said isolated interval after the said selected fluid has been injected into the formation.

9. An apparatus for obtaining information to correct reservoir deliverability and/or absolute open flow potential of a subterranean formation, by means of a downhole tool conveyed by a wireline cable, comprising:
(a) an arrangement of rubber inflatable packers for isolating the well bore from an interval of interest;
(b) a measurement section containing fluid measurement sensors located between the said packers;
(c) a valve body section containing control valves located above the said packers;
(d) a pump located above said valve body;
(e) an electric motor connected to said pump located above said pump;
(f) an electronics section located above said electric motor;
(g) a telemetry communications system located in the electronics section communicates to a surface computer system via the said wireline cable;
(h) sample chambers located below said packers; and
(i) flow control lines for establishing fluid communication between said packers, said measurement section, said valve body, said pump and said sample chambers.

10. The apparatus according to claim 9 further comprising;
(a) the electronics section controls the speed of the electric motor which regulates the pumping rate of the pump.

11. The apparatus according to claim 9 further comprising:
(a) a valve in said valve body to establish flow communication through the said flow control lines from an inlet between said inflatable rubber packers and the said pump;
(b) a valve to establish flow communication via said flow control lines from said pump to said inflatable rubber packers;
(c) a valve to establish flow communication via said flow control lines from said pump to said sample chambers;
(d) a valve to establish flow communication via said flow control lines from said pump to well bore;
(e) a valve to establish flow communication via said flow control lines from a sample chamber to the said pump; and
(f) a valve to reverse the intake and exhaust lines from the said pump.

12. The said inflatable rubber packers according to claim 9 further comprising:
(a) a variable length spacer sub between the said packers; and
(b) support arms located at the bottom of the top packer and at the top of the bottom packer.

* * * * *